US010499165B2

(12) United States Patent
Fretz

(10) Patent No.: US 10,499,165 B2
(45) Date of Patent: Dec. 3, 2019

(54) FEEDBACK REDUCTION FOR HIGH FREQUENCIES

(71) Applicant: IntriCon Corporation, Arden Hills, MN (US)

(72) Inventor: Robert J. Fretz, Maplewood, MN (US)

(73) Assignee: IntriCon Corporation, Arden Hills, MN (US)

( * ) Notice: Subject to any disclaimer, the term of this patent is extended or adjusted under 35 U.S.C. 154(b) by 204 days.

(21) Appl. No.: 15/596,894

(22) Filed: May 16, 2017

(65) Prior Publication Data

US 2017/0332180 A1 Nov. 16, 2017

Related U.S. Application Data

(60) Provisional application No. 62/337,153, filed on May 16, 2016.

(51) Int. Cl.
*H04R 25/00* (2006.01)

(52) U.S. Cl.
CPC ..... *H04R 25/453* (2013.01); *H04R 25/353* (2013.01); *H04R 25/505* (2013.01); *H04R 2430/03* (2013.01)

(58) Field of Classification Search
CPC . H04R 25/353; H04R 25/505; H04R 2430/03
See application file for complete search history.

(56) References Cited

U.S. PATENT DOCUMENTS

| | | | | |
|---|---|---|---|---|
| 7,519,193 | B2 | 4/2009 | Fretz | |
| 7,609,841 | B2 * | 10/2009 | Freed | H04R 25/453 381/318 |
| 8,170,248 | B2 | 5/2012 | Hersbach et al. | |
| D671,218 | S | 11/2012 | Daavettila et al. | |
| 8,355,517 | B1 * | 1/2013 | Fretz | H04R 25/453 381/317 |
| 8,358,797 | B2 | 1/2013 | Fretz | |
| 8,538,053 | B2 | 9/2013 | Puder | |
| 8,605,927 | B2 | 12/2013 | Fretz et al. | |
| 8,767,987 | B2 | 7/2014 | Fretz | |
| 9,571,939 | B2 | 2/2017 | Fretz et al. | |
| 2008/0027718 | A1 * | 1/2008 | Krishnan | G10L 21/038 704/211 |
| 2017/0078804 | A1 | 3/2017 | Guo et al. | |

* cited by examiner

*Primary Examiner* — Sunita Joshi
(74) *Attorney, Agent, or Firm* — Shewchuk IP Services, LLC; Jeffrey D. Shewchuk

(57) ABSTRACT

A digital signal processor processes acoustic sound in a body-worn hearing assist device including separating the microphone signal into frequency bands. Two of the frequency bands, which are preferably adjacent, are considered as a pair. In one of the frequency bands in the pair, the band signal is replicated/split into two subsignals. One of the subsignals is frequency shifted into the other frequency band of the pair. The input signal from the paired frequency band is either significantly attenuated or altogether discarded. The unshifted subsignal is attenuated relative to the frequency-shifted subsignal, which is preferably amplified, before both subsignals are combined as part of the acoustic output. Considering both frequency bands as a pair, the likelihood of feedback is significantly reduced or eliminated.

24 Claims, 4 Drawing Sheets

FEEDBACK REDUCTION FOR HIGH FREQUENCIES

CROSS-REFERENCE TO RELATED APPLICATION(S)

The present application claims the benefit of U.S. provisional patent application Ser. No. 62/337,153, filed May 16, 2016. The contents of U.S. provisional patent application Ser. No. 62/337,153 are hereby incorporated by reference in entirety.

BACKGROUND OF THE INVENTION

Human hearing is generally considered to be in the range of 20 Hz to 20 kHz, with greatest sensitivity to sounds in the range of 1 kHz to 4 kHz, and with high frequency hearing significantly deteriorating in many older people. In the hearing aid industry, the top of the frequency range of amplified sounds is often around 8 kHz.

One well known problem with hearing aids is their tendency to generate feedback, where the sound output by the receiver in the hearing aid travels back to the microphone in an acoustic feedback loop, to then be reamplified in the next cycle through the hearing aid. With repeated amplification by multiple cycles through the hearing aid, feedback can produce loud and annoying whistles, buzzes and pops in the sound output, which can significantly reduce the quality of the user experience. Moreover, the onset of feedback problems is difficult to predict and depends heavily on the specific acoustic conditions, both in ambient sounds received by the microphone at a particular time and location and in physical acoustic feedback path changes near the ear (such as moving a hand or placing a telephone near the ear). The likelihood of feedback increases with the amplification gain, but large amplification gains are frequently desired to make up for the user's hearing loss, and hearing aid designers must often limit the overall gain to avoid feedback. In hearing aids that use digital signal processors (DSPs), there is commonly an algorithm applied to attempt to cancel or reduce the incidence of feedback.

The problem of feedback cancellation can be particularly difficult at high frequencies, such as in the 4 to 8 kHz range. When amplifying speech, spoken sounds such as "s", "sh", "t" and "k" generally include significant high frequency components which extend broadly through a number of frequency bands in this 4 to 8 kHz range. At the same time, acoustic path changes can result in large phase changes at such high frequencies. If the acoustic path changes occur rapidly, then it is difficult for a DSP feedback canceller to track the changes. Some DSP hearing aids have used broad-based frequency shifting in an attempt to reduce feedback problems, but existing solutions are unsatisfactory. Better methods of avoiding high frequency feedback in hearing aids are needed, particularly for use in amplifying speech and with those having degraded hearing in the higher frequency ranges.

SUMMARY OF THE INVENTION

The present invention involves a method to be employed in a digital signal processor which processes acoustic sound in a body-worn hearing assist device, and the hearing assist device and the digital signal processor which employ the method. The microphone signal is separated into frequency bands, which are then considered in frequency band pairs. The input signal from one of the frequency bands in the pair is either significantly attenuated or altogether discarded. In the other (preferably adjacent) frequency band of the pair, the band signal is replicated/split into two subsignals. One of the subsignals is frequency-shifted into the paired frequency band. The unshifted subsignal is attenuated relative to the frequency-shifted subsignal, which is preferably amplified. The subsignals are then combined into the acoustic output to be heard by the user. Since the input signal of one of the paired frequency bands is discarded or significantly attenuated, the feedback loop is broken there. The reduced gain in the unshifted subsignal significantly reduces the likelihood of feedback in the other frequency band of the pair. Thus, considering both frequency bands, the likelihood of feedback is significantly reduced or eliminated.

While the above-identified drawing figures set forth preferred embodiments, other embodiments of the present invention are also contemplated, some of which are noted in the discussion. In all cases, this disclosure presents the illustrated embodiments of the present invention by way of representation and not limitation. Numerous other minor modifications and embodiments can be devised by those skilled in the art which fall within the scope and spirit of the principles of this invention.

DETAILED DESCRIPTION OF THE PREFERRED EMBODIMENT(S)

The idea of this invention is to use frequency shifting of only selective (generally alternating) frequency bands in the high frequency range, together with different amounts of gain in the various frequency bands, to break up the feedback loop path. For instance, the invention can be applied to the hearing aid and digital signal processor (DSP) disclosed in U.S. Pat. No. 8,355,517, incorporated by reference. Alternatively, the invention can be applied to any other DSP-based, frequency-specific processing of acoustic sound in a body-worn hearing assist device worn by a user.

Figure 1:
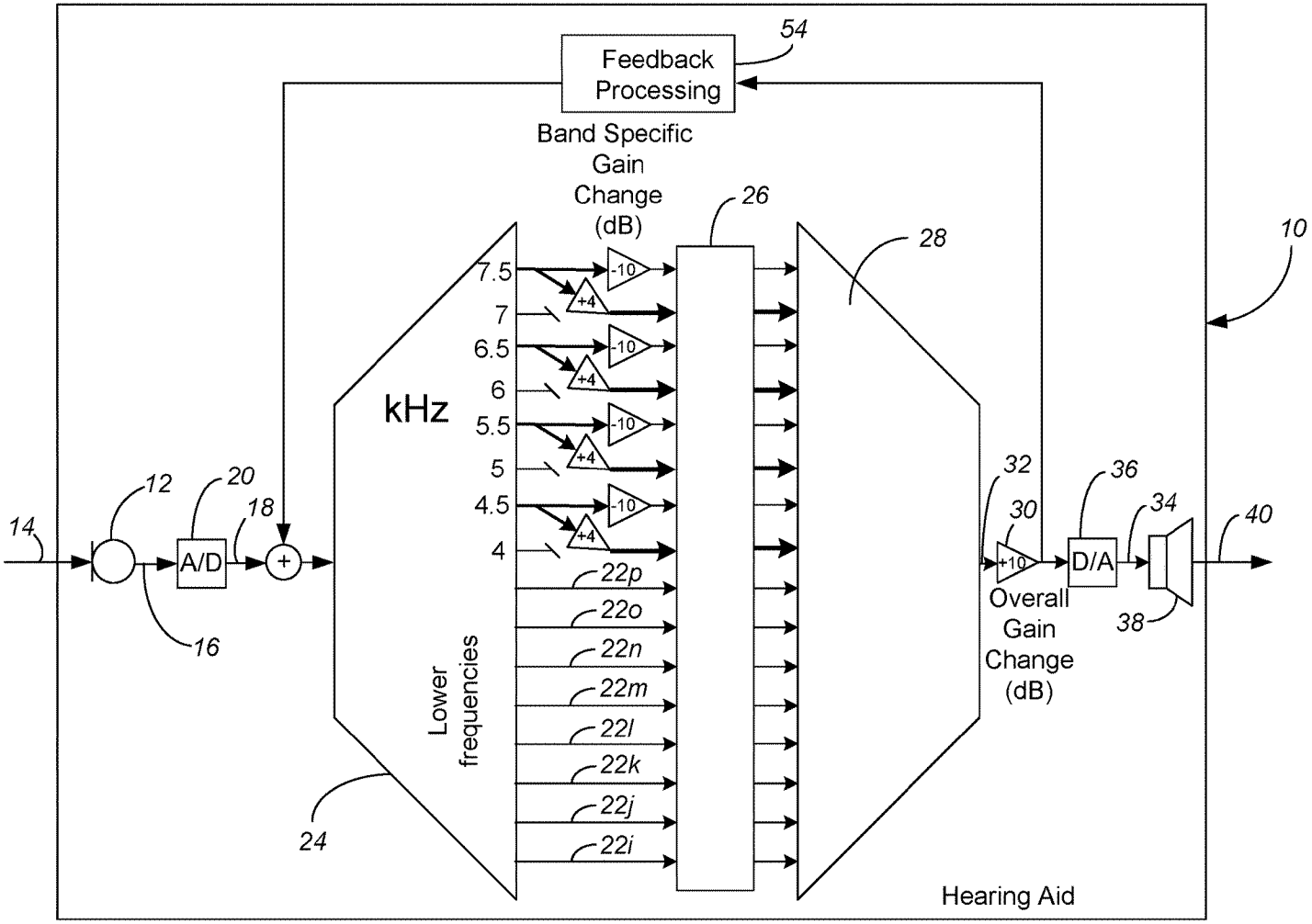
FIG. 1 is a simplified schematic of the DSP signal processing in a hearing aid utilizing a first embodiment of the present invention.
Figure 1A:
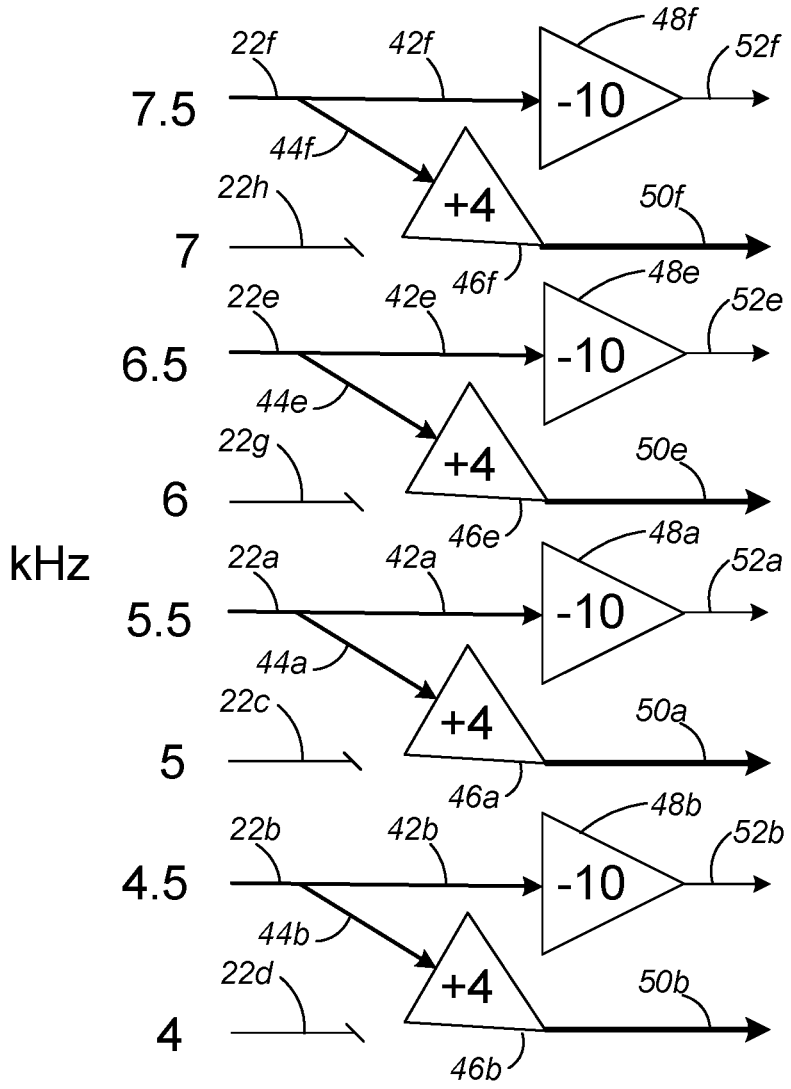
FIG. 1*a* is a view of a portion of FIG. 1, enlarged so reference numerals could be added.

As shown in FIG. 1, a hearing aid 10 includes a microphone 12 which senses acoustic sounds 14 and converts the sounds 14 into an electrical signal 16. While only one microphone 12 is shown, the electrical input signal 16 could be based on a combined input of multiple microphones, or could be combined with other inputs, as long as at least some of the electrical input signal 16 comes from one microphone 12 of the body-worn hearing assist device 10.

The electrical signal 16 is converted to a digital signal 18 using an analog-to-digital ("A/D") converter 20, and then separated out into distinct signals in frequency bands 22*a-p* such as with band pass filters or a weighted overlap-add analyzer 24. This must include separation into at least two frequency bands, and in some aspects must include separation into at least four separate frequency bands, within the frequency range of human hearing of 20 Hz to 20 kHz. In the preferred system into sixteen frequency bands 22*a-p* covering the 20 to 8,000 Hz range. In the preferred embodiment, the frequency bands 22*a-p* include high frequency bands 22*a-h* of:

| Nominal Band of input signal (kHz) | Intended Range from filter separation (kHz) |
|---|---|
| 4 | 3.75-4.25 |
| 4.5 | 4.25-4.75 |
| 5 | 4.75-5.25 |
| 5.5 | 5.25-5.75 |
| 6 | 5.75-6.25 |
| 6.5 | 6.25-6.75 |
| 7 | 6.75-7.25 |
| 7.5 | 7.25-8.0 |

Each frequency band 22 is fed through further feed forward processing 26 (which may includes further gain adjustments, particularly to correspond to the hearing deficiency profile of a particular hearing impaired individual as determined during hearing aid fitting) before being recombined in a summer or more preferably a weighted overlap-add synthesizer 28. Further overall gain 30 may be applied to the combined output 32. The combined output 32 is converted into an analog signal 34 with a digital-to-analog ("D/A") converter 36, which analog signal 34 is fed to a receiver 38 to be output as an audible output 40. The audible output 40 is heard by the wearer, but also a portion of the output 40 travels through an external acoustic feedback path to be picked up by the microphone 12.

Of course, the real-world filtering and separation into bands 22*a-p* is not perfect, so in real applications there is some overlap at the margins between bands. Further, the number of frequency ranges and the selection of the edges of each range are electronic filtering design choices, which could be made by the designers of the DSP chip in some cases or could be made by the hearing aid design (such as in programming the DSP chip) in other cases.

The present invention considers adjacent pairs of frequency bands, and applies different amounts of gain while shifting at least some of the signal between the two paired bands. For instance, in a first embodiment the input signal from the 5.5 kHz band may be considered a frequency band-a. The 5.5 kHz frequency band-a signal 22*a* is replicated and/or split into a first band-a subsignal 42*a* and a second band-a subsignal 44*a*, each carrying the acoustic information of the 5.5 kHz band 22*a*. One of these two subsignals 44*a* is frequency shifted and becomes a frequency-shifted band-a subsignal 44*a*. The other 42*a* of these two subsignals is not frequency shifted, or at a minimum is frequency-shifted by a different amount and/or in a different up/down direction. In the preferred embodiment, the first band-a subsignal 44*a* is frequency shifted downward by the amount of spacing between the adjacent frequency bands 22*a*, 22*c*. Thus, because the adjacent frequency band 22*c* is 5 kHz, or 0.5 kHz lower than the frequency band-a, the first band-a subsignal 44*a* is frequency-shifted downward by 0.5 kHz.

A different amount of relative gain 46*a* is applied to the frequency-shifted band-a subsignal 44*a* than the relative gain 48*a* applied to the second band-a subsignal 42*a*. That is, the input signal 22*a* from the 5.5 kHz band is put out in both the 5.0 kHz and 5.5 kHz bands at different gains. Applying the different relative gains forms a gain-adjusted frequency-shifted band-a subsignal 50*a* and a gain-adjusted second band-a subsignal 52*a*. In this aspect, the important consideration is relative gain difference. For best results, the relative gain 46*a* applied to the frequency-shifted band-a subsignal 44*a* is at least 10 dB greater than the relative gain 48*a* applied to the second band-a subsignal 42*a*.

Because there are other locations in the feed forward DSP processing to apply gain, either the frequency-shifted band-a subsignal 44*a* or the second band-a subsignal 42*a* may have no gain applied, and the relative gains 48*a*, 48*b*, 48*e*, 48*f* shown in FIG. 1 is just as compared to the gain applied in the prior art U.S. Pat. No. 8,355,517 in each particular frequency band 22*a-p*. In the preferred embodiment of FIG. 1, the gain 46*a* of the frequency-shifted band-a subsignal 44*a* is increased by 4 dB from normal, while the gain 48*a* of the second band-a retained subsignal 42*a* is lowered by 10 dB from normal (i.e., the relative gain 46*a* applied to the frequency-shifted band-a subsignal 44*a* is 14 dB greater than the relative gain 48*a* applied to the second band-a subsignal 42*a*). Another way of considering the gains applied is that the frequency-shifted band-a subsignal 44*a* is amplified relative to each of the signals 22*i-p* in the low frequency bands, and that the second band-a retained subsignal 42*a* is attenuated relative to each of the signals 22*i-p* in the low frequency bands. It should be understood that the order of frequency-shifting and amplifying to achieve the gain-adjusted frequency-shifted band-a subsignal 50*a* is insignificant: the split could be frequency-shifted after applying the gain 46*a* to achieve the same result. The gain-adjusted frequency-shifted band-a subsignal 50*a* and the gain-adjusted second band-a subsignal 52*a* are later combined, such as in the weighted overlap-add synthesizer 28.

For aspects of the invention that require separation into at least four separate frequency bands, the first embodiment includes an input signal 22*b* from the 4.5 kHz band that may be considered a frequency band-b. The frequency band-b is separated from the frequency band-a by a third intervening frequency band-c, in this case the 5.0 kHz band. In general terms, the input signal 22*b* in the frequency band-b is processed similarly to the signal 22*a* in the frequency band-a, i.e., it is replicated and/or split, with one 44*b* of the two subsignals then frequency shifted relative to the other 42*b*, and with different amounts of gain 46*b*, 48*b* applied to the frequency shifted band-b signal 44*b* as compare to the second band-b retained subsignal 42*b*. In the preferred embodiment of FIG. 1, the frequency-shifted band-b subsignal 44*a* has been frequency-shifted downward by 0.5 Hz, with its gain 46*b* increased by 4 dB from normal, while the gain 48*b* of the second band-b retained subsignal 42*b* is attenuated by 10 dB from normal. The gain-adjusted frequency-shifted band-b subsignal 50*b*, and the gain-adjusted second band-b subsignal 52*b* are then combined together with the gain-adjusted frequency-shifted band-a subsignal 50*a* and the gain-adjusted second band-a subsignal 52*a*, such as in the weighted overlap-add synthesizer 28.

The signal 22*c* in the frequency band-c (i.e., the intervening frequency band) is significantly attenuated, or, in the preferred embodiment, completely discarded. With the first embodiment involving a downward frequency-shift of subsignals, frequency band-c can be thought of as pairing with frequency band-a. Since the 5 kHz input signal 22*c* of frequency band-c is discarded, the feedback loop is broken in the 5 kHz frequency band-c and there is no possibility of feedback there. The reduction in gain (i.e., the 10 dB attenuation 48*a*) in the 5.5 kHz band significantly reduces the likelihood of feedback in the 5.5 kHz band. Thus, considering frequency band-a (5.5 kHz) and frequency band-c (5.0 kHz) as a pair, the likelihood of feedback has been significantly reduced or eliminated.

A fourth frequency band-d, that receives the gain adjusted frequency-shifted signal from frequency band-b, is treated similarly to frequency band-c. That is, the 4.0 kHz frequency band-d signal 22*d* is, in the preferred embodiment, completely discarded. Since the 4.0 kHz input signal 22*d* of frequency band-d is discarded, the feedback loop is broken in the 4.0 kHz frequency band-d and there is no possibility of feedback there. The reduction in gain (i.e., the 10 dB attenuation 48*b*) in the 4.5 kHz band-b subsignal 44*b* significantly reduces the likelihood of feedback in the 4.5 kHz band. Thus, considering frequency band-b (4.5 kHz) and frequency band-d (4.0 kHz) as a pair, the likelihood of feedback has been significantly reduced or eliminated.

The preferred embodiment has four frequency band pairs in which the identical strategy is employed. That is, the input signals 22*d*, 22*c*, 22*g*, 22*h* in each of the 4, 5, 6 and 7 kHz bands are discarded. The gain 48*b*, 48*a*, 48*e*, 48*f* is reduced for each of the retained subsignals 42, 42*a*, 42*e*, 42*f* to prevent feedback in each of the 4.5, 5.5, 6.5 and 7.5 bands. The gain 46*b*, 46*a*, 46*e*, 46*f* is increased for each of the frequency-shifted subsignals 50*b*, 50*a*, 50*e*, 50*f* output in each of the 4, 5, 6 and 7 kHz bands. The likelihood of feedback is eliminated or significantly reduced in each of the 4/4.5, the 5/5.5, the 6/6.5 and the 7/7.5 kHz band pairs.

The location where the invention is applied in the feed forward frequency band processing (i.e., before the further processing 26 as shown in FIG. 1, after the further processing 26 or as part of the further processing 26) is not particularly critical. In particular, the further processing 26 in the digital signal processor allows different hearing profile gains to be applied to each of the frequency bands separate from the employment of the strategy of the present invention. The important concept is that the frequency bands are treated differently and preferably considered in pairs, each frequency band pair handled so that any potential portion of the input signal received in the microphone 12 which was attributable to the acoustic feedback path is eliminated or significantly reduced in either its first or second cycle through the DSP.

Figure 2:
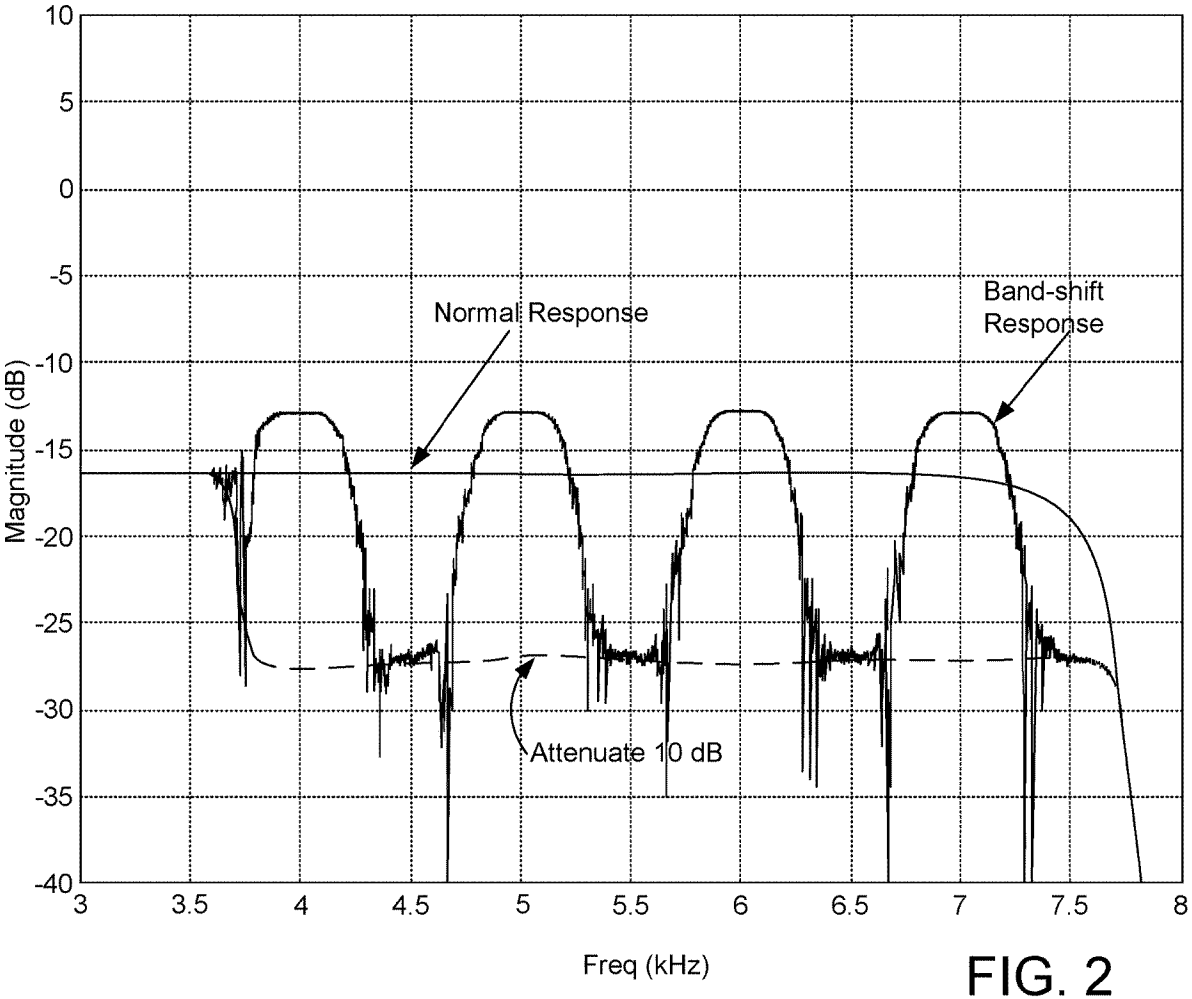
FIG. 2 is a chart generally showing the benefit achieved with the preferred first embodiment.

The frequency response of this preferred algorithm is shown in the graph of FIG. 2. One can see the reduced gain at 4.5, 5.5, 6.5 and 7.5 kHz. The gain here is about 10 dB less than the normal response. The signal from these bands is shifted and output at 4.0, 5.0, 6.0 and 7.0 kHz. The output in these bands is also increased by about 4 dB. This 4 dB increase in gain for these bands compensates for the 10 dB reduction in gain for the adjacent bands. The result is that the perceived loudness of the band-shift response (i.e., the perceived loudness from using the present invention, without increasing the overall hearing aid gain) is about the same as the perceived loudness of the normal response (i.e., is the same as the perceived loudness of the prior art U.S. Pat. No. 8,355,517 output).

This technique involving a) discarding the even band signals; b) replicating/splitting the odd band signals; c) shifting down the subsignal in of each pair of splits; c) increasing the downshifted subsignal gain by 4 dB; and d) decreasing the unshifted subsignal gain by 10 dB, has been found to work well. This algorithm allows an addition of about 10 dB to the overall hearing aid gain 30 at roughly the same feedback issues. This results in a somewhat distorted output 40, but testing has surprisingly indicated that the distortion is acceptable if this aggressive gain and feedback avoidance method is done only for these high (4 to 8 kHz) frequency bands. The technique can be used with other feed forward processing (either upstream and/or downstream of the present invention) and with other feedback processing 54 in the hearing aid 10.

The perceptual impact of the exclusion/splitting/shifting is small due to the fact that at the higher frequencies (over 4 kHz), most inputs have a spectrum that spreads across at least 1 kHz. The spread of the input spectrum at higher frequencies is particularly true in amplifying speech, such as "s", "sh", "t" and "k" sounds. The result is that some part of the input is given a greater non-feedback-inducing gain and provided to the listener. The listener's frequency discrimination is weaker at these high frequencies so the frequency shift is only minimally discernable. The exclusion and shifting causes signal distortion, but if done only in high audio frequencies, the perceptual impact to the listener is minimal.

Various other embodiments of the invention are contemplated, including the following:

While the method could be used across a broader (such as 1 to 8 kHz) or narrower (such as 6 to 8 kHz) frequency range, employing the method across the 4 to 8 kHz range has provided the best results (i.e., lowest perceptual impact at highest gain without feedback) in the hearing aids and environments tested. Thus, in the preferred embodiments, the electrical input signal is further separated into one or more low frequency bands below 4 kHz, and none of the low frequency band signals 22*i-p* are frequency shifted.

The gains 46*a*, 46*b*, 46*e*, 46*f* to the split signals 44*a*, 44*b*, 44*e*, 44*f* could be adjusted to values other the 4 dB increase to the downshifted split (such as another value of increase in the 2 to 10 dB range) and the 10 dB decrease 48*a*, 48*b*, 48*e*, 48*f* to the unshifted split 42*a*, 42*b*, 42*e*, 42*f* could be adjusted to other values (such as another value of decrease in the 5 to 40 dB range). The +4 dB and −10 dB values have been found to result in a generally unchanged overall signal power and rounded out sound, particularly as perceived by the user.

Figure 3:
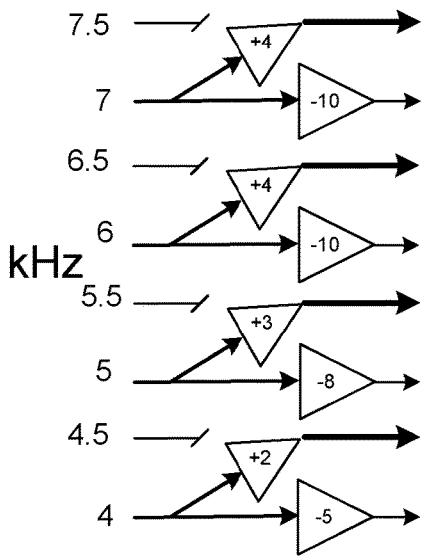
FIG. 3 is a schematic showing a high frequency portion of the DSP signal processing in a second embodiment of the present invention.

The method could also be performed by shifting up as schematically depicted in a second embodiment shown in FIG. 3 rather than shifting down. Shifting down of the first embodiment tends to result in better hearing and understanding of speech in users with high frequency hearing loss, which is why downshifting is preferred over upshifting. However, whether downshifting or upshifting, the beneficial elimination or significant reduction of feedback is retained. FIG. 3 also depicts another change from FIG. 1, that the gain values need not be the same in each of the frequency band pairs. In particular, the method can be more vigorously applied in frequency band pairs where feedback is more likely, and less vigorously applied in frequency band pairs where feedback is occasional or less common. In FIG. 3, the downshifted subsignal gain in the 5/5.5 frequency band pair is increased by 3 dB and the unshifted subsignal gain in the 5/5.5 frequency band pair is decreased by 8 dB. In FIG. 3, the downshifted subsignal gain in the 4/4.5 frequency band pair is increased by 2 dB and the unshifted subsignal gain in the 4/4.5 frequency band pair is decreased by 5 dB. Testing can be applied to real world situations for each DSP hearing aid which uses the present invention, with the gain/attenuation adjustment made customized in each frequency band pair for that hearing aid and/or for that particular user's hearing loss profile.

Figure 4:
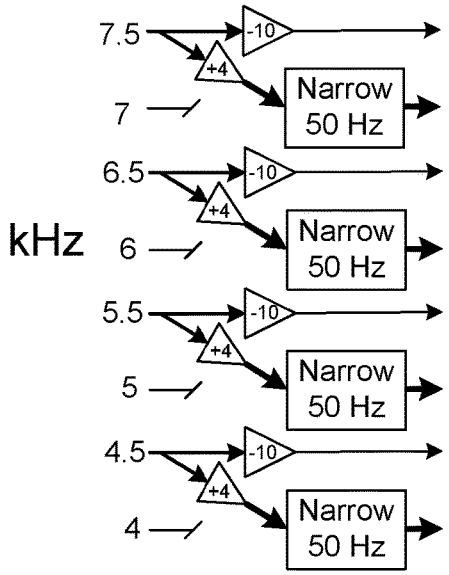
FIG. 4 is a schematic showing a high frequency portion of the DSP signal processing in a third embodiment of the present invention.

In testing the preferred embodiment of FIG. 1, there appears to be some built up of the feedback at the band edges. The invention is modified as shown in FIG. 4 to compensate and address the band edge problem. In FIG. 4, each gain-adjusted downshifted subsignal has its bandwidth narrowed. In the particular embodiment of FIG. 4, with the frequency bands initially having a 0.5 kHz width, the preferred amount of narrowing is about 10%, or about 50 Hz. This is preferably accomplished by using subband filtering to eliminate/reduce the top 50 Hz of each gain adjusted downshifted subsignal. For instance, the frequency band-a subsignal from the 5.5 KHz input band, downshifted 0.5 kHz and with its gain increased by 10 dB, is then further filtered to be within the range of 4.75-5.20 kHz. Thus, the band edge at 5.20-5.25 kHz has additional processing to further minimize the possibility of feedback build-up. If desired, the retained, unshifted subsignal could be subband filtered (alternatively or in addition to the subband narrowing shown in FIG. 4) to achieve the same result.

Figure 5:
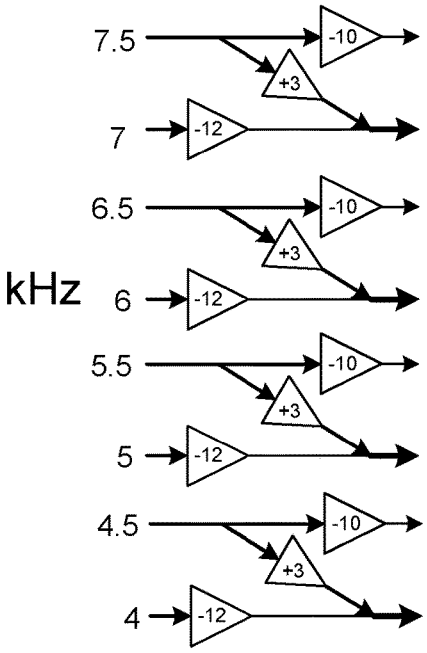
FIG. 5 is a schematic showing a high frequency portion of the DSP signal processing in a fourth embodiment of the present invention.

The discarding of the even band signals could be replaced with a gain reduction of the even band signals, with such an embodiment shown in FIG. 5. For instance, the 4, 5, 6 and 7 kHz inputs could have a gain reduction of 10 to 20 dB (in this case, a −12 dB attenuation) and then added to the downshifted subsignals. If the even (attenuated) band signals are added to the downshifted amplified subsignals, then the gain increase to the downshifted subsignals may be reduced (in this case, to a 3 dB gain increase) to produce a generally unchanged overall signal power and rounded out sound.

If the even band signals are retained as shown in FIG. 5, then they could also undergo a similar splitting/downshifting (not shown), with the downshifted subsignal from the even band signals having a higher applied gain than the unshifted retained subsignal.

Figure 6:
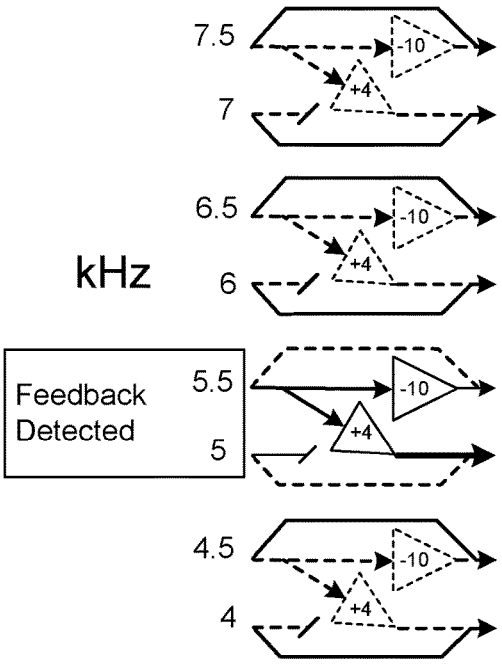
FIG. 6 is a schematic showing a high frequency portion of the DSP signal processing in a fifth embodiment of the present invention.

Yet another alternative occurs if the hearing aid has an algorithm which can analyze the DSP processing (such as how quickly coefficients are changing in the feedback canceller 54). In general, the strategy employed by the present invention need not be a full time method of avoid or minimize feedback, but can instead be a change employed by the hearing aid whenever a feedback event is detected as currently occurring or being likely to occur. It should be understood that the term "event" is used herein as defined by whichever feedback detection algorithm is in place, and need not be limited to occasions when feedback artifacts are being heard by the user. The feedback detection might apply to the entire strategy, i.e., the high frequency processing would be as taught in the prior art U.S. Pat. No. 8,355,517 (and would look identical to the low frequency processing in FIG. 1) unless and until feedback was detected, at which time the hearing aid 10 would switch to the strategy shown in FIG. 1 for a limited period of time until the feedback event or conditions terminated. Alternative, as shown in FIG. 6, the hearing aid 10 might have feedback detection which also identifies the frequency band or bands in which the feedback event was occurring. In FIG. 6, the feedback detector has identified a feedback event in either the 5 and/or 5.5 kHz band. While the feedback event is occurring, the hearing aid 10 employs the strategy of the present invention only in the 5/5.5 kHz frequency band pair, as shown in solid lines in FIG. 6. The other frequency band pairs (i.e., the 4/4.5, 6/6.5 and 7/7.5 frequency band pairs stand at ready with the strategy of the present invention shown ready for deployment in dashed lines, but not applying the present invention in the 4/4.5, 6/6.5 and 7/7.5 frequency band pairs. One benefit of employing the strategy of the present invention at limited times and/or in limited frequency band pairs is that the sound profile is not distorted at times when no frequency event is being detected. Another benefit is that the frequency band pairs need not be permanently married, for instance, at some times (particularly if the feedback event is detected particularly in the 4.5 kHz band) the 4.5 kHz and 5 kHz bands can be paired together, with the input signal in the 4.5 kHz band being discarded or significantly attenuated and the 5 kHz band replicated/split and the 5 kHz subsignal downshifted. In other words, depending upon which frequency the feedback event is detected in, frequency band pairs of 4.5/5, 5.5/6 and/or 6.5/7 can alternatively be created. The detriment of the embodiment of FIG. 6 is that switching back and forth between employing and not employing the inventive strategy of can itself produce more noticeable/annoying artifacts in the sound output 40 of the hearing aid 10. Yet another embodiment would employ the inventive strategy in a ramp-over-time fashion, i.e., using the invention as shown in FIG. 5 but with the relative gains 46, 48 changing more gradually over a phase-in period of time when a feedback event is being detected and over a phase-out period of time thereafter.

The various embodiments disclosed herein are not mutually exclusive. For instance, the different relative gains in each frequency band pair of the second embodiment of FIG. 3 can be combined with any of the other disclosed embodiments, the narrowing of the third embodiment of FIG. 4 can be combined with any of the other disclosed embodiments, and/or the feedback detection and limited employment of the fifth embodiment of FIG. 6 can be combined with any of the other disclosed embodiments.

Although the present invention has been described with reference to preferred embodiments, workers skilled in the art will recognize that changes may be made in form and detail without departing from the spirit and scope of the invention.

The invention claimed is:

1. A method of processing acoustic sound in a body-worn hearing assist device worn by a user, comprising:

receiving acoustic sound in a microphone of the body-worn hearing assist device to convert the acoustic sound into an electrical input signal;

separating the electrical input signal into distinct signals in each of at least four separate frequency bands, each of the four frequency bands being within the frequency range of 20 Hz to 20 kHz;

in a frequency band-a of the at least four frequency bands:

replicating/splitting the frequency band-a signal into a first band-a subsignal and a second band-a subsignal, each of the first band-a subsignal and the second band-a subsignal carrying acoustic information of the frequency band-a signal;

frequency shifting the first band-a subsignal into a frequency-shifted band-a subsignal, but not frequency shifting the second band-a subsignal; and applying a relative gain to the frequency-shifted band-a subsignal which is different than a relative gain applied to the second band-a subsignal, thereby forming a gain-adjusted frequency-shifted band-a subsignal and a gain-adjusted second band-a subsignal;

in a frequency band-b of the at least four frequency bands:

replicating/splitting the frequency band-b signal into a first band-b subsignal and a second band-b subsignal, each of the first band-b subsignal and the second band-b subsignal carrying acoustic information of the frequency band-b signal;

frequency shifting the first band-b subsignal into a frequency shifted band-b subsignal, but not frequency shifting the second band-b subsignal; and applying a relative gain to the frequency shifted band-b subsignal which is different than a relative gain applied to the second band-b subsignal, thereby forming a gain-adjusted frequency-shifted band-b subsignal and a gain-adjusted second band-b subsignal;

combining the gain-adjusted frequency-shifted band-a subsignal, the gain-adjusted second band-a subsignal, the gain-adjusted frequency-shifted band-b subsignal, and the gain-adjusted second band-b subsignal into a combined electrical output signal; and transforming the combined electrical output signal in a receiver of the body-worn hearing assist device into an acoustic output to be heard by the user, with at least a portion of the acoustic output received by the microphone.

2. The method of claim 1, wherein the relative gain applied to the frequency shifted band-a subsignal is greater than the relative gain applied to the second band-a subsignal, and wherein the relative gain applied to the frequency shifted band-b subsignal is greater than the relative gain applied to the second band-b subsignal.

3. The method of claim 2, wherein the gain-adjusted frequency-shifted band-a subsignal is amplified relative to the first band-a subsignal, and wherein the gain-adjusted frequency-shifted band-b subsignal is amplified relative to the first band-b subsignal.

4. The method of claim 3, wherein the amount of amplification of the first band-a subsignal is equal to the amount of amplification of the first band-b subsignal.

5. The method of claim 2, wherein the gain-adjusted second band-a subsignal is attenuated relative to the second band-a subsignal, and wherein the gain-adjusted second band-b subsignal is attenuated relative to the second band-b subsignal.

6. The method of claim 5, wherein the amount of attenuation of the second band-a subsignal is equal to the amount of attenuation of the second band-b subsignal.

7. The method of claim 1, wherein the body-worn hearing assist device is a hearing aid, wherein the electrical input signal is a digital signal prior to being separated, wherein the replicating/splitting, frequency shifting and applying acts all occur in a digital signal processor, and wherein the digital signal processor allows different hearing profile gains to be applied to band-a and band-b.

8. The method of claim 1, wherein frequency band-a is non-adjacent to frequency band-b and is separated from frequency band-b by a frequency band-c of the at least four frequency bands.

9. The method of claim 8, wherein the frequency band-c signal is attenuated.

10. The method of claim 8, wherein the frequency band-c signal is not replicated/split.

11. The method of claim 8, wherein no portion of the band-c signal is combined into the combined electrical output signal.

12. The method of claim 8, wherein frequency band-a has a frequency band-a center frequency; wherein frequency band-c has a frequency band-c center frequency which differs from the frequency band-a center frequency by a band-a/band-c spacing, and wherein the amount of the frequency shift of the first band-a subsignal is equal to the band-a/band-c spacing.

13. The method of claim 1, wherein the frequency shifting in band-a and the frequency shifting in band-b are both downward to lower frequencies.

14. The method of claim 1, wherein each of the four frequency bands is within the frequency range of 4 kHz to 8 kHz.

15. The method of claim 14, wherein electrical input signal is further separated into one or more low frequency bands below 4 kHz, and wherein none of the low frequency band signals are frequency shifted.

16. The method of claim 14, wherein wherein frequency band-a is non-adjacent to frequency band-b and is separated from frequency band-b by a frequency band-c of the at least four frequency bands;

wherein frequency band-a has a frequency band-a center frequency; wherein frequency band-c has a frequency band-c center frequency which differs from the frequency band-a center frequency by a band-a/band-c spacing, and wherein the amount of the frequency shift of the first band-a subsignal is equal to the band-a/band-c spacing;

wherein the frequency-shifted band-a subsignal has been frequency shifted downward by the band-a/band-c spacing relative to the second band-a subsignal; and wherein the relative gain applied to the frequency-shifted band-a subsignal is at least 10 dB greater than the relative gain applied to the second band-a subsignal.

17. The method of claim 1, wherein the body-worn hearing assist device is adapted to be worn in the ear, with the microphone and the receiver in a single housing.

18. A method of processing acoustic sound in a body-worn hearing assist device worn by a user, comprising:

receiving acoustic sound in a microphone of the body-worn hearing assist device to convert the acoustic sound into an electrical input signal;

filtering the electrical input signal to create a distinct frequency band-a signal, while removing the portion of the electrical input signal in an adjacent frequency band, both of frequency band-a and the adjacent frequency band being within the frequency range of 20 Hz to 20 kHz;

in frequency band-a:

replicating/splitting the frequency band-a signal into a first band-a subsignal and a second band-a subsignal, each of the first band-a subsignal and the second band-a subsignal carrying acoustic information of the frequency band-a signal; and frequency shifting the first band-a subsignal into a frequency-shifted band-a subsignal moved into the adjacent frequency band;

combining at least the frequency-shifted band-a subsignal and the second band-a subsignal into a combined electrical output signal; and transforming the combined electrical output signal in a receiver of the body-worn hearing assist device into an acoustic output to be heard by the user, with at least a portion of the acoustic output received by the microphone.

19. The method of claim 18, further comprising detecting a feedback event in one of frequency band-a and the adjacent frequency band, and employing the method of claim 18 for a limited period of time while the feedback event is detected.

20. The method of claim 18, wherein the filtering the electrical input signal creates at least three separate frequency bands, with frequency band-a and the adjacent frequency band being two of the at least three separate frequency bands, and further comprising detecting a feedback event in at least one of the at least three separate frequency bands, and selecting which of the at least three separate frequency bands is band-a based upon the frequency band where the frequency event is detected.

21. A method of processing acoustic sound in a body-worn hearing assist device worn by a user, comprising:

receiving acoustic sound in a microphone of the body-worn hearing assist device to convert the acoustic sound into an electrical input signal;

filtering the electrical input signal to create a distinct frequency band-a signal and a distinct frequency band-b signal, both of frequency band-a and frequency band-b being within the frequency range of 20 Hz to 20 kHz, frequency band-a having a frequency band-a width;

in a frequency band-a:

replicating/splitting the frequency band-a signal into a first band-a subsignal and a second band-a subsignal, each of the first band-a subsignal and the second band-a subsignal carrying acoustic information of the frequency band-a signal; and frequency shifting and narrowing the first band-a subsignal into a frequency-shifted narrowed band-a subsignal which has been moved into frequency band-b and has a frequency-shifted band-a width which is narrower than the frequency band-a width;

combining at least the frequency-shifted band-a subsignal and the second band-a subsignal into a combined electrical output signal; and transforming the combined electrical output signal in a receiver of the body-worn hearing assist device into an acoustic output to be heard by the user, with at least a portion of the acoustic output received by the microphone.

22. A method of processing acoustic sound in a body-worn hearing assist device worn by a user, comprising:

receiving acoustic sound in a microphone of the body-worn hearing assist device to convert the acoustic sound into an electrical input signal;

separating the electrical input signal into distinct signals in separate frequency bands, the frequency bands having a frequency band spacing;

in a frequency band-a of the separate frequency bands, frequency band-a being at a frequency range where feedback artifacts are common:

replicating/splitting the frequency band-a signal into a first band-a subsignal and a second band-a subsignal, each of the first band-a subsignal and the second band-a subsignal carrying acoustic information of the frequency band-a signal;

frequency shifting the first band-a subsignal into a frequency-shifted band-a subsignal which has been frequency shifted lower than the second band-a subsignal; and amplifying the frequency-shifted band-a subsignal while attenuating the second band-a subsignal, thereby forming an amplified frequency-shifted band-a subsignal and an attenuated second band-a subsignal, both the amplification and the attenuation being relative to at least one signal from a different one of the separate frequency bands;

combining the amplified frequency-shifted band-a subsignal, the attenuated second band-a subsignal, and signals from others of the separate frequency bands into a combined electrical output signal; and transforming the combined electrical output signal in a receiver of the body-worn hearing assist device into an acoustic output to be heard by the user, with at least a portion of the acoustic output received by the microphone.

23. A digital signal processor for processing a signal generated by a microphone in a body-worn hearing assist device worn by a user, where the digital signal processor is programmed to:

separate an electrical input signal into distinct signals in separate frequency bands, the frequency bands having a frequency band spacing;

in a frequency band-a of the separate frequency bands, frequency band-a being at a frequency range where feedback artifacts are common:

replicating/splitting the frequency band-a signal into a first band-a subsignal and a second band-a subsignal, each of the first band-a subsignal and the second band-a subsignal carrying acoustic information of the frequency band-a signal;

amplifying the first band-a subsignal while attenuating the second band-a subsignal, thereby forming an amplified band-a subsignal and an attenuated band-a subsignal, both the amplification and the attenuation being relative to at least one signal from a different one of the separate frequency bands;

frequency shifting the amplified band-a subsignal into an amplified frequency-shifted band-a subsignal which has been frequency shifted relative to the attenuated band-a subsignal; and combining the amplified frequency-shifted band-a subsignal, the attenuated band-a subsignal, and signals from others of the separate frequency bands into a combined electrical output signal.

24. The digital signal processor of claim 23 in a body-worn hearing assist device which further comprises:

a housing adapted to be worn in the ear;

a microphone within the housing receiving acoustic sound and convert the acoustic sound into an analog electrical input signal;

an analog to digital converter within the housing to convert the analog electrical input signal into a digital electrical input signal fed to the digital signal processor;

a digital to analog converter within the housing to convert the combined electrical output signal into an analog output signal; and a receiver within the housing to transform the analog output signal into an acoustic output to be heard by the user, with at least a portion of the acoustic output received by the microphone.

* * * * *